US007060945B2

(12) United States Patent
Kondou et al.

(10) Patent No.: US 7,060,945 B2
(45) Date of Patent: Jun. 13, 2006

(54) SUBSTRATE HEATER AND FABRICATION METHOD FOR THE SAME

(75) Inventors: Nobuyuki Kondou, Handa (JP); Hideyoshi Tsuruta, Toukai (JP)

(73) Assignee: NGK Insulators, Ltd., Nagoya (JP)

( * ) Notice: Subject to any disclaimer, the term of this patent is extended or adjusted under 35 U.S.C. 154(b) by 14 days.

(21) Appl. No.: 10/945,269

(22) Filed: Sep. 20, 2004

(65) Prior Publication Data

US 2005/0082274 A1 Apr. 21, 2005

(30) Foreign Application Priority Data

Sep. 30, 2003 (JP) ..... P2003-340920

(51) Int. Cl.
*H05B 3/68* (2006.01)

(52) U.S. Cl. ..... 219/444.1; 219/443.1; 219/465.1; 219/543; 219/546; 219/390; 219/405; 219/466.1; 392/416; 392/418; 118/724; 118/725; 118/50.1; 118/728; 118/729; 118/730

(58) Field of Classification Search ..... 219/443.1, 219/444.1, 465.1, 466.1, 543, 544, 546, 547, 219/548, 390, 405, 411; 118/724, 725, 50.1, 118/728–730; 392/414, 418
See application file for complete search history.

(56) References Cited

U.S. PATENT DOCUMENTS 6,534,751 B1 * 3/2003 Uchiyama et al. ..... 219/444.1
6,730,175 B1 * 5/2004 Yudovsky et al. ..... 118/728

FOREIGN PATENT DOCUMENTS

JP 2002-083858 A1 3/2002

* cited by examiner

*Primary Examiner*—Shawntina Fuqua
(74) *Attorney, Agent, or Firm*—Burr & Brown

(57) ABSTRACT

A substrate heater is provided including a plate-shaped ceramic base having a first side defining a convex heating surface on at least a portion of which a substrate is placed, a resistance-heating element embedded in the ceramic base, and a tubular member joined to a central portion on an opposed second side of the ceramic base. The convex heating surface has a central portion and a peripheral portion, wherein the height of the heating surface decreases from the central portion toward the peripheral portion thereof.

12 Claims, 5 Drawing Sheets

SUBSTRATE HEATER AND FABRICATION METHOD FOR THE SAME

CROSS-REFERENCE TO RELATED APPLICATIONS

This application is based upon and claims the benefit of priority from Japanese Patent Application No. 2003-340920 filed on Sep. 30, 2003; the entire contents of which are incorporated herein by reference.

BACKGROUND OF THE INVENTION

The present invention relates to a substrate heater for heating a semiconductor wafer, a liquid crystal substrate, and the like, which is used in a semiconductor fabricating process. More specifically, the present invention relates to a substrate heater where a resistance-heating element is embedded in a ceramic base.

Semiconductor equipment employs a substrate heater. The substrate heater employs a ceramic heater where a linear resistance-heating element is embedded in a discoid ceramic base. The substrate heater also extensively employs a ceramic heater with an electrostatic chuck function, where an electrostatic chuck electrode for fixing a substrate by adsorption is embedded with a resistance-heating element.

This ceramic heater includes a base formed of highly corrosion resistant ceramic, and the resistance-heating element is not exposed to the outside. For this reason, the ceramic heater is suitable for use in a chemical vapor deposition (CVD) apparatus, a dry etching apparatus, and the like, which frequently apply corrosive gas.

The ceramic heater employed in the semiconductor equipment is applicable to a wide temperature range depending on the application, specifically a range of room temperature to a high temperature equal to or above 500° C. Meanwhile, for improvement in product yields, it is important to ensure temperature uniformity on the substrate. For this reason, the substrate heater is required to have temperature uniformity at a high temperature on a substrate-placing surface, that is, a substrate heating surface.

For example, to improve temperature uniformity on a heating surface of a ceramic heater, conventionally, a method of achieving temperature uniformity on a heating surface has been disclosed (see Japanese Patent Publication No. 2527836, FIG. 1 and FIG. 3, etc.). According to this method, the spiral resistance-heating element embedded in the ceramic base is adjusted in spiral pitch and shape depending on the location.

In a substrate heater used in a CVD apparatus or a dry etching apparatus, the resistance-heating element has a terminal drawn outside without being exposed to the corrosive gas. For this reason, the following structure is frequently adopted, where the lower central portion of the ceramic base is joined to a shaft as a tubular member, and the shaft houses the terminal of the resistance-heating element, a feed bar to be connected thereto, and the like therein.

SUMMARY OF THE INVENTION

In case of the ceramic heater provided with a shaft, heat tends to escape through the shaft joined to the ceramic base by way of heat transfer. Such a phenomenon tends to lower the temperature at the central portion of the heating surface in comparison with the peripheral portion thereof. In particular, a highly heat conductive material used as the shaft is highly likely to have such a tendency.

Meanwhile, the heating surface of the conventional ceramic heater is required to be as flat as possible in order to increase close contact with the substrate. Such flatness has been ensured by a lapping operation and the like. The substrate, mounted on the heating surface having fine flatness, tends to exhibit temperature distribution which directly reflects temperature distribution on the heating surface of the ceramic heater. Accordingly, the use of the ceramic heater with the shaft causes the central portion of the substrate surface to have a tendency to exhibit a temperature distribution which is lower than that of the outer peripheral portion thereof.

For improving the temperature uniformity on the heating surface of the substrate heater, the method employs an adjustment of the spiral resistance-heating element in spiral pitch and shape. In the meantime, the presence or absence of the shaft or the shape of the shaft requires optimization of the shape of the resistance-heating element, which renders the design of the resistance-heating element troublesome and makes the process of the resistance-heating element complicated. After the formation of the ceramic base with the resistance-heating element embedded therein, the resistance-heating element is incapable of adjustment in position and the like. Accordingly, it is difficult to perform a delicate correction operation.

The present invention is directed to a substrate heater and a method for fabricating the same. The substrate heater includes a tubular member (a shaft) joined thereto and is capable of achieving a uniform temperature distribution on a substrate using a simple method.

The first aspect of the present invention provides a substrate heater including a plate-shaped ceramic base having a heating surface on a side of the ceramic base for placing a substrate thereon, and a resistance-heating element embedded in the ceramic base. The substrate heater also includes a tubular member joined to a central portion on another side of the ceramic substrate. The height of the convex-shaped heating surface decreases from a central portion of the heating surface to a peripheral portion thereof.

The entirely convex heating surface, with the substrate placed thereon, improves in closest contact with the substrate and the central portion of the heating surface. This enhances the efficiency of heat transfer at the central portion, while relatively lowering the efficiency of heat transfer at the peripheral portion. Thus, although the central portion of the heating surface itself is lower in temperature than the peripheral portion, due to the influence of heat transfer, the surface of the substrate placed on the heating surface is heated with a more uniform temperature distribution.

The ceramic base may include a planar electrode embedded therein between the heating surface and the resistance-heating element. The planar electrode may include a mesh-shaped electrode of a metal bulk body or a plate-shaped electrode with open holes.

The heating surface may have a vacuum chuck hole configured to adsorb and fix the substrate on the heating surface.

The adsorption force of an electrostatic chuck further secures close contact force between the substrate and the heating surface at the central portion of the heating surface. This enhances the substantial contact area, achieving a higher effect in heat transfer. The adsorption force of the electrostatic chuck stably retains the substrate, thus reliably achieving the shape-effect of the heating surface.

The heating surface has a height Hc at the central portion and a height He at an end of the heating surface. The difference $\Delta H$ between the heights Hc, He is 50 μm or less.

The height difference ΔH of 50 μm or less maintains an electrostatic chuck or a vacuum chuck at the peripheral portion of the substrate, thus stably keeping treatment in the substrate.

The second aspect of the invention provides a method for fabricating a substrate heater including the step of embedding a resistance-heating element in a plate-shaped ceramic base. The method includes a step of grinding a surface of the ceramic base into a convex heating surface, wherein the height of the heating surface decreases from a central portion to a peripheral portion thereof. The method also includes a step of joining a tubular member to a central portion on another surface of the ceramic substrate.

The simple operation of grinding the entire heating surface into a convex shape provides the closest contact between the substrate and the central portion of the substrate, thus enhancing efficiency in heat transfer. Though the central portion of the heating surface itself has a lower temperature than the peripheral portion due to the influence of heat transfer, the surface of the substrate placed on the heating surface obtains uniform temperature distribution.

The step of embedding may include a step of embedding a planar electrode in the ceramic base.

The addition of an electrostatic chuck function to the substrate heater further secures close contact force between the substrate and the central portion of the heating surface. This improves the substantial contact area, thus achieving a higher effect in heat transfer. The adsorption force of electrostatic chuck function stably retains the substrate, clarifying shape effect of the heating surface.

The step of grinding may include a step of adjusting the difference AH between height Hc of the central portion and height He of an end on the heating surface to be 50 μm or less.

The difference ΔH of 50 μm or less maintains an electrostatic chuck or a vacuum chuck at the peripheral portion of the substrate, thus stably keeping treatment of the substrate.

The substrate heater and the fabrication method have a heating surface formed into a convexity by a simple grinding operation. This allows the heating surface to achieve a uniform temperature distribution relative to the heating surface in a substrate heater with a tubular member.

DETAILED DESCRIPTION OF THE INVENTION

The following describes a substrate heater and a fabrication method thereof according to an embodiment of the present invention with reference to the accompanying drawings.

Figure 1A:
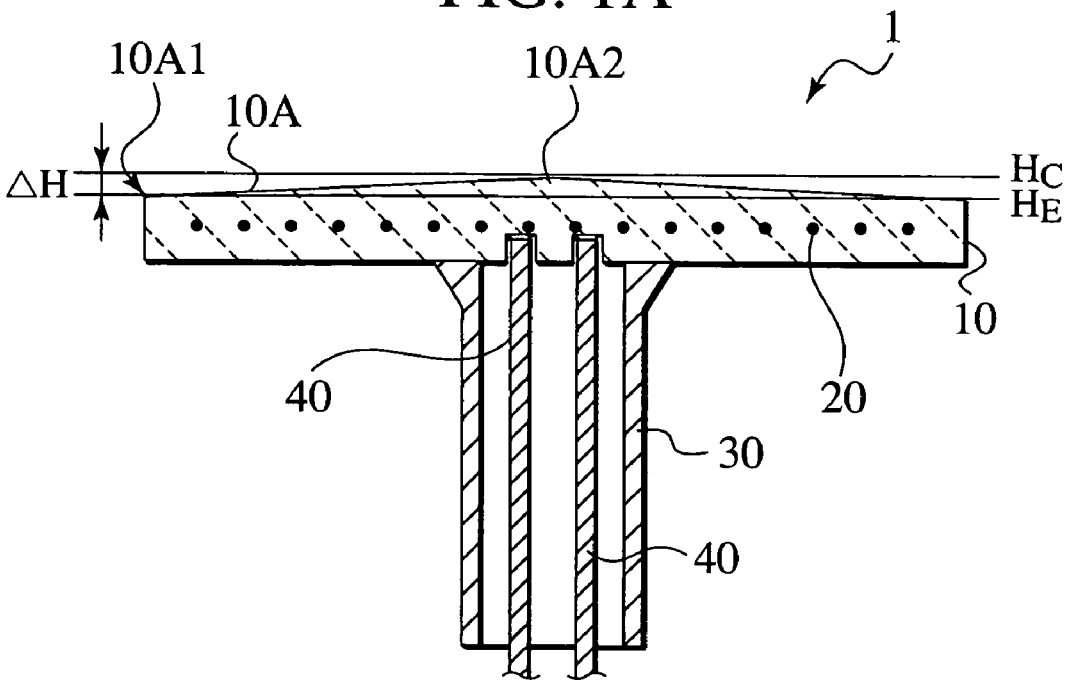
FIGS. 1A and 1B are cross-sectional views illustrating a structure of a substrate heater according to an embodiment of the present invention.

Referring to FIG. 1A, the structure of a substrate heater according to the embodiment of the present invention is described. A substrate heater 1 includes a ceramic base 10. The ceramic base 10 is made of an approximately discoid ceramic sintered body, for example, and includes a linear resistance-heating element 20 which is embedded inside the ceramic sintered body. The discoid ceramic base 10 includes a heating surface 10A on a side thereof. The heating surface 10A includes a semiconductor substrate or a glass substrate as an object to be heated which is mounted thereon. The ceramic base 10 is joined to a shaft 30, or a tubular member, at the central portion on the opposite side. The shaft 30 houses a feed bar 40 as a feeder for supplying electricity to the resistance-heating element 20, in the tube thereof. The end of this feed bar 40 is connected to a terminal of the resistance-heating element 20 by brazing solder or the like. In this way, joining of the shaft 30 to the central portion on the opposite side of the ceramic base 10 allows for heat-transfer to the shaft 30. The heat-transfer provides a tendency for the heating surface 10A to have a temperature lower at the central portion than at the outer peripheral portion.

Figure 1B:
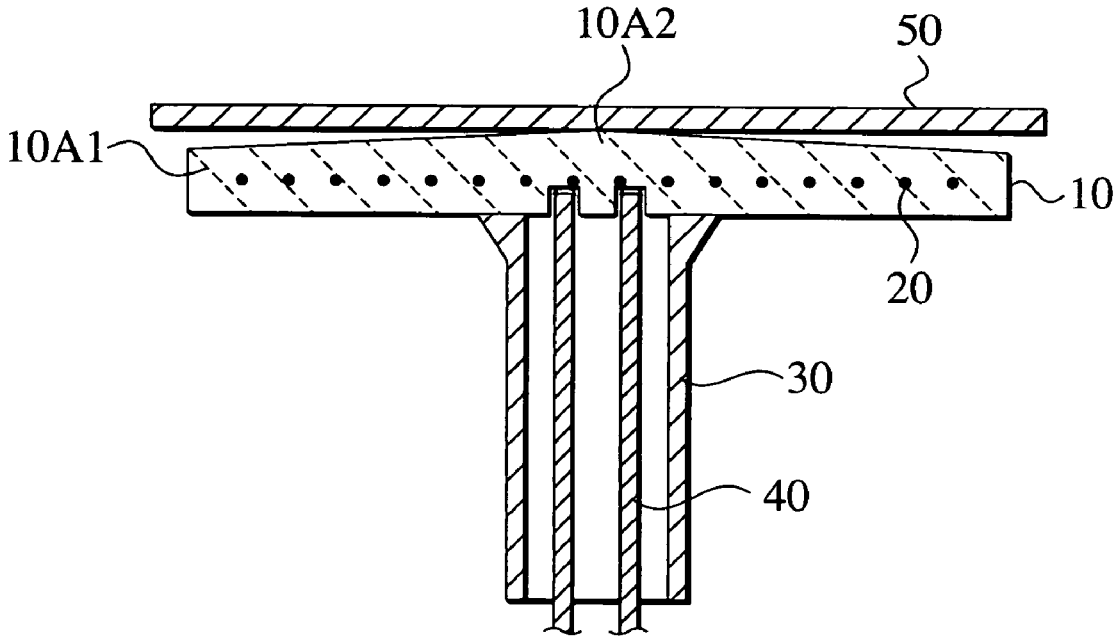

The substrate heater 1, however, has a main characteristic in that the heating surface 10A has a convex shape, where the height of the central portion 10A2 is set to be highest and the height of the heating surface is gradually lowered as the heating surface extends toward the peripheral portion 10A1. Accordingly, as shown in FIG. 1B, when a substrate 50 is mounted on the heating surface 10A, the substrate 50 contacts the heating surface 10A closely at the central portion 10A2 of the heating surface 10A due to its own weight. Such contact provides fine heat-transfer efficiency and thereby raises the substrate temperature efficiently. To the contrary, the substrate 50 retains slight clearance between the heating surface 10A and the substrate 50 at the outer peripheral portion. The clearance reduces the heat transfer efficiency at the outer peripheral portion 10A1 more than at the central portion 10A2. That is, if the heating surface 10A is a flat surface as in the conventional case, the temperature distribution on the surface of the substrate 50 will directly reflect the temperature distribution on the heating surface 10A of the ceramic base 10. To the contrary, the substrate heater 1 of the embodiment has the heating surface 10A in a convex shape. This shape increases the heat transfer efficiency to the substrate at the central portion 10A2 with a low temperature, and relatively reduces the heat transfer efficiency to the substrate at the outer peripheral portion 10A1 with a high temperature. In this way, it is possible to correct the temperature distribution on the substrate surface to be more uniform.

Here, the heating surface 10A has a height Hc at the central portion 10A2, and a height He at the edge portion 10A1. The difference AH (=Hc−He) in the height is preferably set to be equal to or less than 30 μm. The difference above 30 μm renders the substrate 50 unstable, with the substrate placed on the heating surface 10A.

The difference ΔH is preferably set to be at least 10 μm, more preferably, to be at least 20 μm. This ensures temperature uniformity on the substrate surface, thus rendering the difference in the heat conductivity between the central portion 10A2 and the outer peripheral portion 10A1 of the heating surface more effective.

Figure 2A:
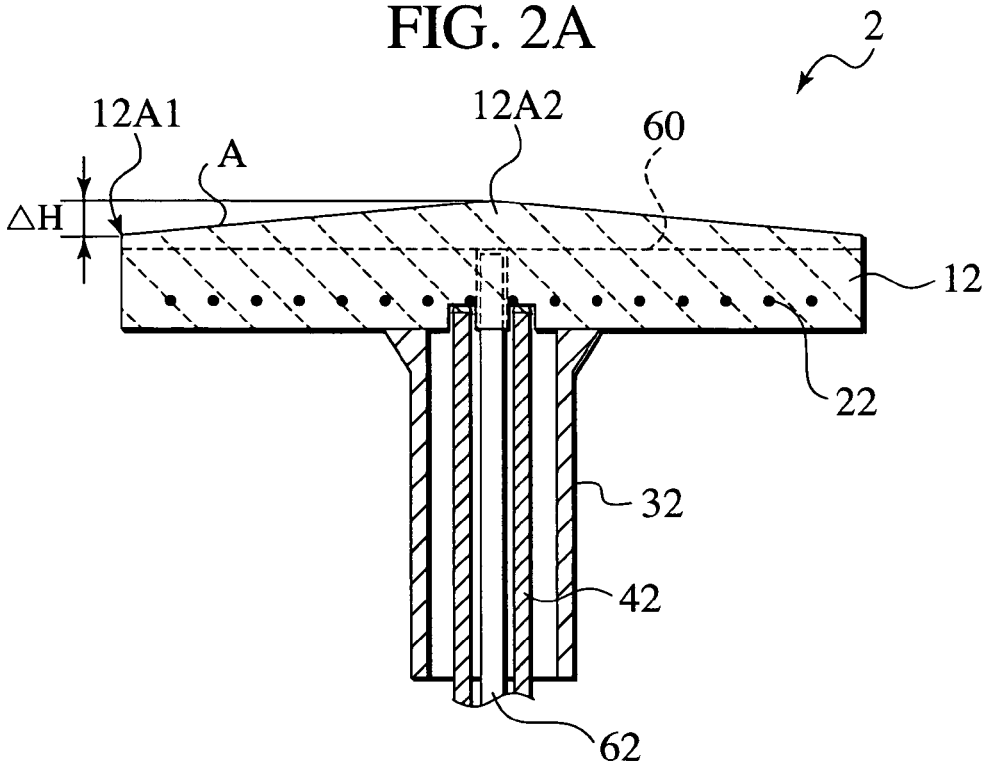
FIGS. 2A and 2B are cross-sectional views illustrating structures of a substrate heater with an electrostatic chuck and of a substrate heater with a vacuum chuck according to another embodiments of the present invention.
Figure 2B:
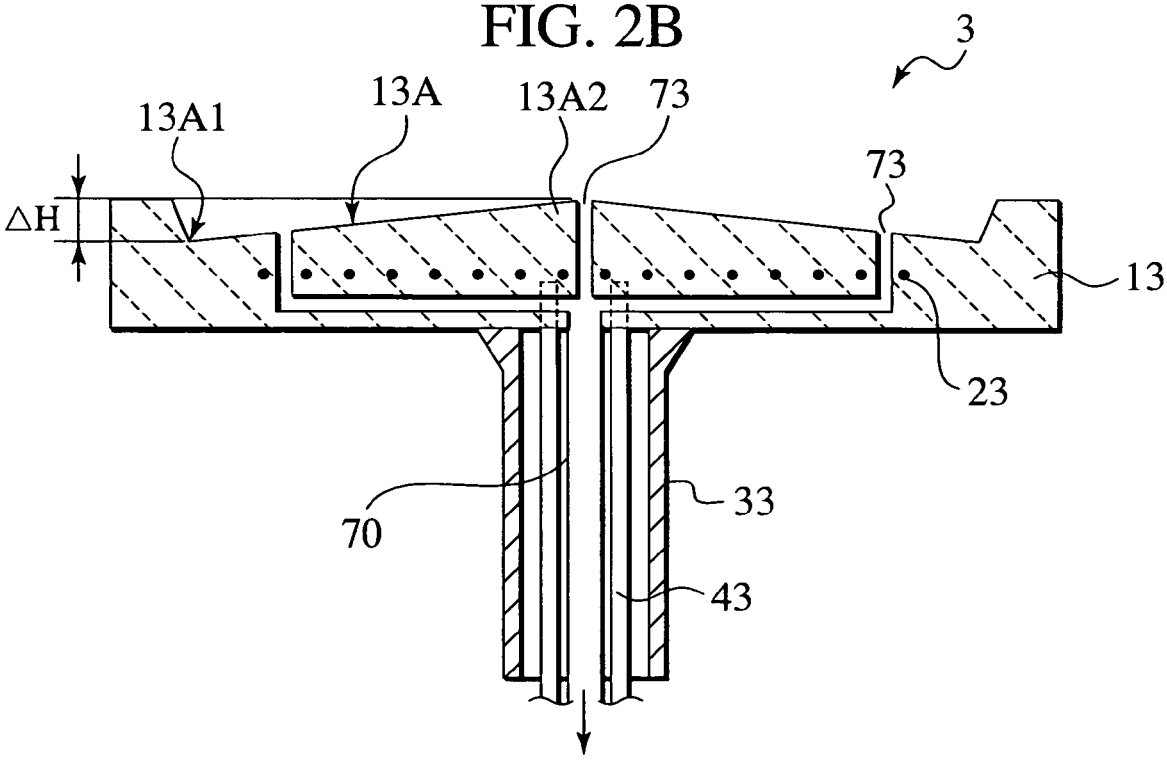

Referring to FIGS. 2A and 2B, the following describes examples of the structures of substrate heaters 2 and 3 provided with substrate adsorption functions according to another embodiments of the present invention. The substrate heaters 2 and 3 with the adsorption functions retains the substrate more stably than the substrate heater 1 shown in FIG. 1A.

The substrate heater 2 shown in FIG. 2A includes a resistance-heating element 22 and an electrostatic chuck electrode 60 which are embedded in a ceramic base 12 made of an approximately discoid ceramic sintered body. The ceramic base 12 includes a shaft 32 which is connected to the rear surface thereof. The shaft 32 houses therein a feed bar 42 for supplying electricity to a terminal of the resistance-heating element 22, and a feed bar 62 as a feeder to the electrostatic chuck electrode 60. In this way, the ceramic base 12 is joined to the shaft 32 at the central portion on the rear surface thereof. Such a joint allows a tendency that heat transfer from the shaft 32 lowers the temperature at the central portion 12A2 of a heating surface 12A.

In the meantime, the substrate heater 2 with the electrostatic chuck includes a heating surface 12A. The heating surface 12A has a convex shape in which, as in the case of the substrate heater shown in FIG. 1A, the height of the central portion 12A2 is set to be highest and the height of the heating surface is gradually reduced toward the peripheral portion 12A1 thereof. Compared to the case of a substrate mounted on a flat heating surface, a substrate mounted on the heating surface 12A having a convex shape tends to be unstable without any fixing means. The substrate of the substrate heater 2 shown in FIG. 2A, however, is tightly adsorbed and fixed to the heating surface 12A due to the electrostatic chuck function. The heating surface 12A has a convex shape in which the central portion 12A2 is set to be highest. This shape allows the substrate to closely contact the central portion 12A2 of the heating surface 12A due to adsorption by the electrostatic chuck. This results in a substantially expanded contact area, which achieves high heat-transfer efficiency. This heat-transfer efficiency raises the substrate temperature efficiently. To the contrary, a slight clearance is maintained between the heating surface 12A and the substrate at the outer peripheral portion of the heating surface 12A, and this clearance reduces the heat-transfer efficiency. This result improves the temperature uniformity on the substrate surface mounted on the heating surface 12A.

When the Johnson-Rahbek principle is applied to the adsorbability of the electrostatic chuck, the distance between the heating surface 12A and the substrate mounted on the heating surface 12A influences the adsorbability. For this reason, when the central portion 12A2 of the heating surface has a height Hc, and the edge portion 12A1 of the heating surface has a height He, a difference ΔH (=Hc−He) in the height exceeding 50 μm hinders sufficient adsorbability, which brings the substrate into a floating state. Therefore, a difference ΔH equal to or less than 50 μm is preferred for ensuring stable retention of the substrate.

The difference ΔH that is preferably set to be at least 10 μm, more preferably, at least 20 μm, ensures the temperature uniformity on the substrate surface, and clarifies the difference in the heat conductivity between the central portion 12A2 and the outer peripheral portion 12A1 of the heating surface 12A.

The substrate heater 3 shown in FIG. 2B includes a vacuum chuck function. The substrate heater 3 is different from the substrate heater 2 in that the vacuum chuck function is used as the adsorption function. Other parts of the fundamental structure are similar to those in the substrate heater provided with the electrostatic chuck shown in FIG. 2A.

As shown in FIG. 2B, a ceramic base 13 includes a resistance heating element 23 embedded therein and vacuum chuck adsorption holes 73 arranged at multiple positions. These adsorption holes 73 are connected to an exhaust pipe 70. A substrate to be mounted on a heating surface 13A is fixed to the substrate heating surface 13A by adsorption through the respective adsorption holes 73. The adsorption holes 73 are not particularly limited in the number and locations.

As shown in FIG. 2B, the ceramic base 13 of the substrate heater 3 includes a heating surface 13A for mounting the substrate at the central portion, and the heating surface 13A is surrounded by a frame part having a certain height. Such a frame part facilitates maintenance of a vacuum state.

The rear surface of the ceramic base 13 is connected to a shaft 33. The shaft 33 houses the exhaust pipe 70 therein, in addition to a feed bar 43 for supplying electricity to a terminal of the resistance-heating element 23. Heat transfer from the shaft 33 tends to lower the temperature at the central portion of the heating surface 13A.

In this substrate heater 3, the heating surface 13A also has a convex structure. Specifically, the height of the central portion 13A2 is set to be the highest and the height of the heating surface is gradually reduced toward the outer peripheral portion 13A1 thereof. The heating surface 13A closely contacts the substrate at the central portion 13A2 thereof due to the adsorbability by the vacuum chuck. Such contact provides fine heat transfer efficiency as a result of the substantial expansion of the contact area, as well as raises the substrate temperature efficiently. At the same time, the heat transfer efficiency is slightly reduced at the outer peripheral portion 13A1 of the substrate due to clearance provided between the heating surface 13A and the substrate.

To maintain the adsorbability of the substrate by the vacuum chuck, a difference ΔH (=Hc−He) in the height set to be equal to or below 50 μm is preferred for ensuring stable retention of the substrate where the height of the heating surface 13A at highest position in the central portion 13A2 is Hc and the height of the heating surface at the lowest position at the edge portion 13A1 is He, for example. That is, when the distance between the adsorption hole 73A and the substrate is 50 μm or more, there is an increase in leakage, thus bringing the substrate into a floating state. This does not maintain adsorbability to the heating surface 13A to be stable.

The difference ΔH is preferably set to be at least 10 μm, more preferably, at least 20 μm. The difference ΔH renders the difference in the heat conductivity between the central portion and the outer peripheral portion of the heating surface more effective, thus ensuring temperature uniformity on the substrate surface.

Next, a method of fabricating the substrate heater according to the embodiment of the present invention will be described with reference to the flowchart of FIG. 3. Here, the method of fabricating a substrate heater 2 provided with an electrostatic chuck as shown in FIG. 2A will be described as a typical example. The ceramic base, the resistance-heating element, and the shaft may apply similar materials respectively in other substrate heaters.

Figure 3:
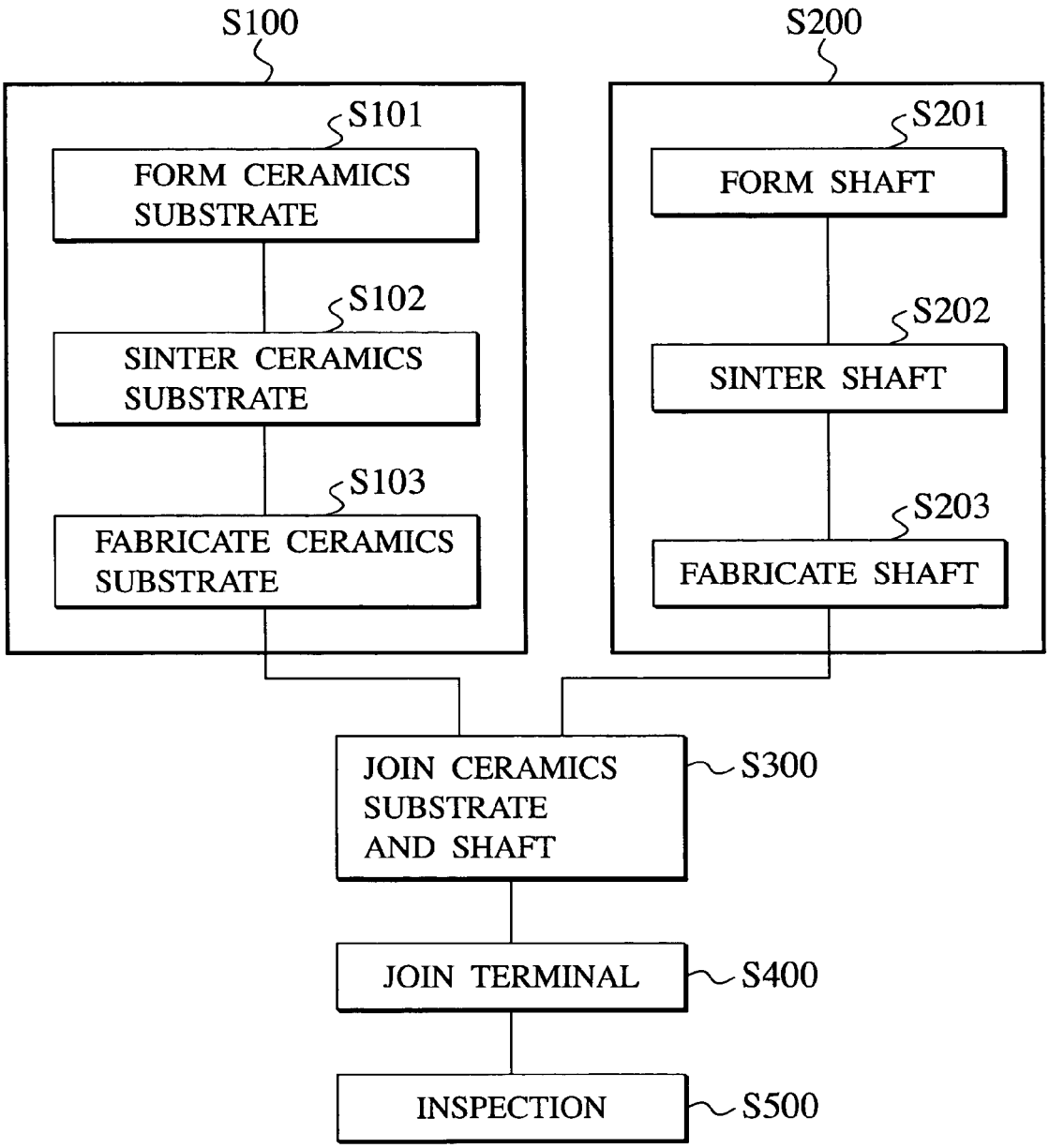
FIG. 3 is a flowchart diagram illustrating a fabrication method for the substrate heater illustrated in FIG. 1A.

As shown in FIG. 3, for fabricating the substrate heater 2, the ceramic base is first fabricated, with the resistance-heating element and the electrostatic chuck electrode embedded therein (S100). At the same time, the shaft made of a ceramic sintered body is fabricated (S200). The ceramic base and the shaft are then joined together (S300). The necessary terminal is joined to the shaft (S400) and the substrate heater is completed after an inspection operation (S500).

The following specifically describes the respective steps.

Firstly, in the ceramic base fabricating step (S100), the ceramic base is formed and then a ceramic base compact with the resistance-heating element and the electrostatic chuck embedded therein is fabricated (S101). This compact is sintered into the sintered body (S102), and then this sintered body is machined (S103). In the step of grinding the sintered body, the heating surface of the ceramic base is machined into a convex shape where the height is greatest at the central portion.

Specifically, in the ceramic base forming step (S101), ceramic raw material powder and sintering aids are put into a mold and pressed together, thereby fabricating a preliminary compact. The resistance-heating element is mounted on the preliminary compact, the ceramic raw material powder is put thereon, and these constituents are pressed together again. When mounting the resistance-heating element, it is possible to form grooves in advance in locations on the preliminary compact for mounting the resistance-heating element. Then, the electrostatic chuck electrode made of a metal bulk body in the form of a mesh, for example, is mounted thereon. After putting the ceramic raw material powder thereon successively, all the constituents are pressed together again in a uniaxial direction. This forms the compact of the ceramic base with the resistance-heating element and the electrostatic chuck electrode embedded therein. The ceramic raw material powder may be formed by using AlN, SiC, SiNx, sialon or the like as a main ingredient with addition of rare earth oxides such as $Y_2O_3$ as sintering aids.

Figure 4A:
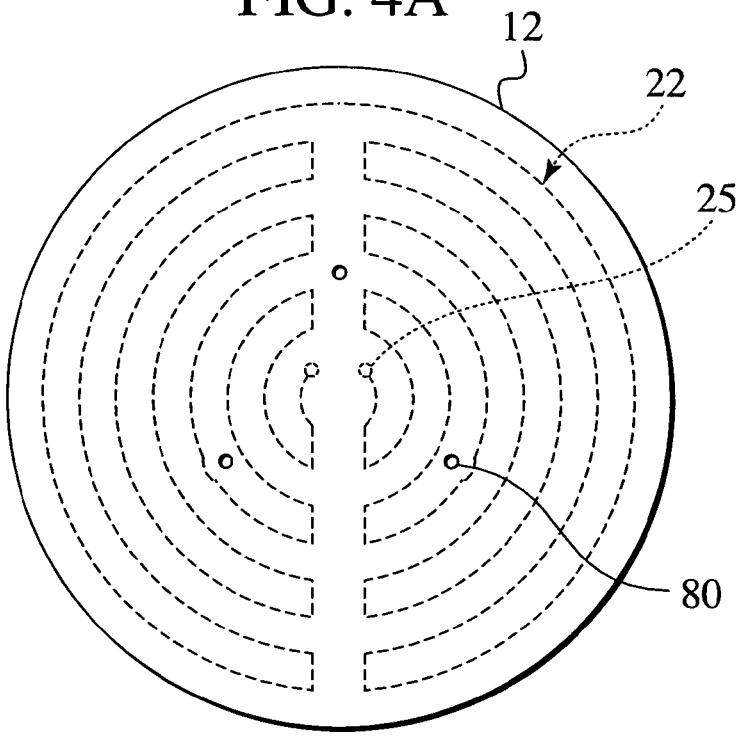
FIGS. 4A and 4B are plan views illustrating shapes of resistance-heating elements to be embedded in the substrate heater illustrated in FIG. 1A.
Figure 4B:
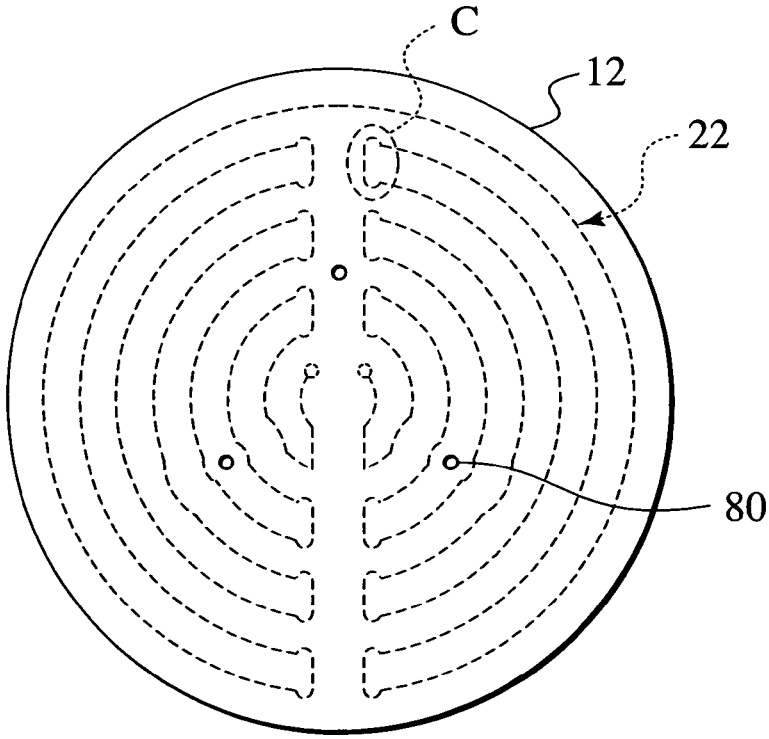

Examples of resistance-heating elements having a planar shape to be embedded in the ceramic base will be described with reference to FIG. 4A and FIG. 4B. The resistance-heating element 22 applies a single linear body, which is the metal bulk body made of a high-melting point material such as Mo, W, or WC. As shown in FIG. 4A, this linear body includes two terminals 25 for the resistance-heating element which are positioned in the center. The linear body is folded back into a coil body. This coil shape may be modified into various shapes. As shown in FIG. 4A, it is possible to apply local modification around lift pins 80 so as to circumvent the lift pins 80 at a certain distance. Alternatively, as shown in FIG. 4B, folded portions C of the resistance-heating element 22 are provided with slight bulges. This narrows the distance between the adjacent resistance-heating elements, thus improving the temperature uniformity of the heating surface 12A.

The electrostatic chuck preferably applies an electrode made of a refractory metal such as Mo, W, or WC, that is capable of enduring the sintering temperatures, as in the case of the resistance-heating element. For the electrostatic chuck, it is also possible to use an electrode made of a metal bulk body in the form of a mesh or an electrode having a punching metal shape provided with numerous holes on a plate body. Such a metal bulk body can lower the resistance of the electrode, and therefore may be used as a radio-frequency electrode. As to the metal bulk body, a hot press method may be used in the sintering step.

The resistance-heating element or the electrostatic chuck may employ a printed electrode. In this case, it is difficult to embed the electrode in the ceramic powder in the forming step. Accordingly, the printed electrode is formed on a green sheet instead. It is also possible to fabricate a compact of the ceramic base by laminating other green sheets on the printed electrode.

In the ceramic base sintering step (S102), the compact obtained in the forming step is sintered by use of the hot press method, for example. When aluminum nitride powder is used as the ceramic raw material powder, the conditions for sintering are set to a nitrogen atmosphere, temperature in a range from 1700° C. to 2000° C., and a time period from about 1 hour to 10 hours. The pressure for the hot-press is preferably set to be from 20 kg/cm$^2$ to 1000 kg/cm$^2$ or above, or more preferably, from 100 kg/cm$^2$ to 400 kg/cm$^2$. The hot-press method applies pressure in a uniaxial direction during sintering, thus achieving fine close contact of the resistance-heating element and the electrostatic chuck electrode to the surrounding ceramic base. The metal bulk electrode is not deformed by the pressure applied during the hot-press sintering.

In the ceramic base processing step (S103), the sintered ceramic base is subjected to a drilling operation for providing holes for drawing out electrode terminals and a chamfering operation for corners. Concurrently, the heating surface 12A of the ceramic base is machined into a certain convex shape. The grinding of the surface of the ceramic base is performed with a flat-surface grinding machine. The heating surface 12A is formed into the shape having a height Hc at the central portion 12A2 and a height He at the edge portion 12A1 of the heating surface 12A. The difference AH therebetween is set to be in a range of 10 μm to 50 μm, more preferably, in a range of 20 μm to 40 μm.

This ceramic base processing step does not always have to be performed upon completion of the sintering step. Instead, it is possible to perform the processing step by using a half-completed sintered body obtained by sintering at a temperature which is slightly lower than the required sintering temperature or by sintering for a shorter period. By processing the half-completed sintered body before fully completing the sintering, the processing becomes easier to perform. When processing the half-completed sintered body, the half-completed sintered body is subjected to sintering again after the process.

Figure 5A:
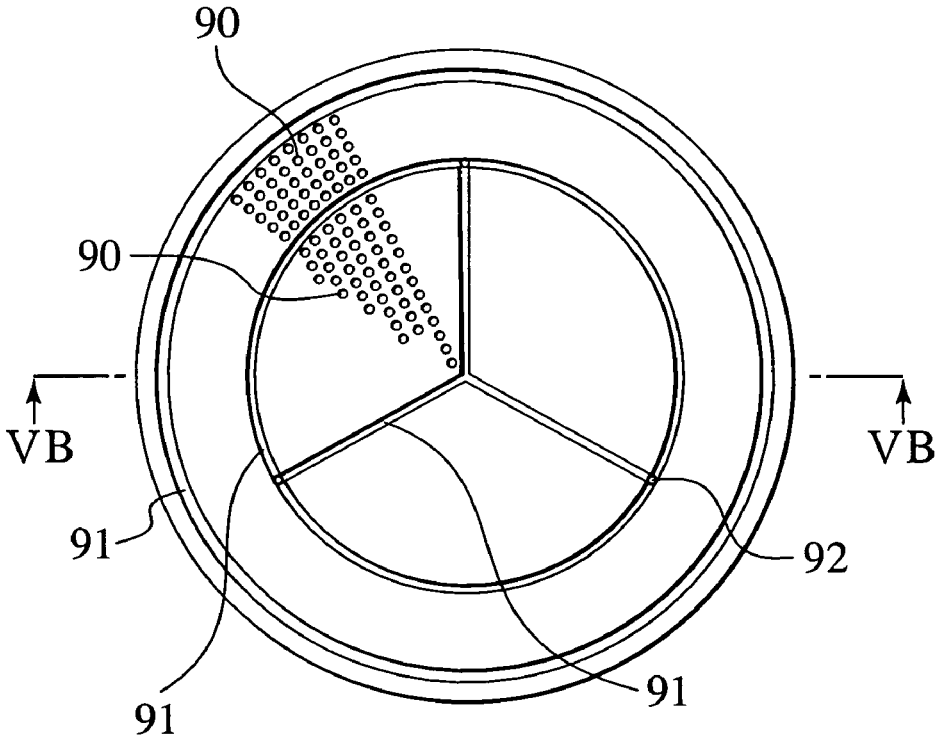
FIG. 5A is a plan view and FIG. 5B is a cross-sectional view respectively illustrating a structure of the substrate heater having a heating surface subjected to an embossing operation according to the embodiment of the present invention.
Figure 5B:
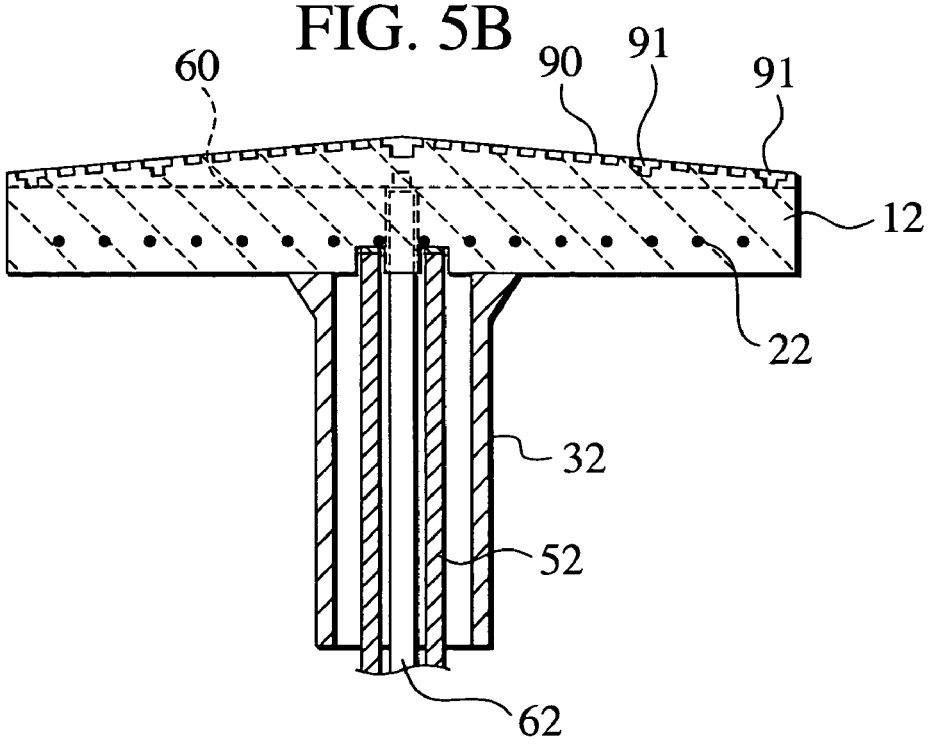

In the ceramic base processing step (S103), as shown in FIG. 5A and FIG. 5B, it is also possible to form embossments 90 on the surface of the ceramic base by use of a sandblasting method or the like. It is also possible to form purge gas holes 92, purge gas grooves 91, or holes for lift pins.

In the shaft fabricating step (S200), a compact of the shaft is first formed using a ceramic raw material powder (S201). This compact is sintered into a sintered body (S202), and then this sintered body is processed (S203).

In the shaft forming step (S201), it is preferable to use a ceramic raw material powder of the same quality as that used in the ceramic base. In this way, it is possible to obtain a fine joint property to the ceramic base. Although various methods can be applied to the forming method, it is preferable to apply a cold isostatic pressing (CIP) method, a slip casting method, and the like, which are suitable for forming a relatively complicated shape.

In the shaft sintering process (S202), the compact obtained in the forming step is sintered. A compact having the complicated shape is preferably sintered by use of a normal pressure sintering method. When AlN is used as the ceramic raw material, conditions for sintering are set to a nitrogen atmosphere, temperature in a range from 1700° C. to 2000° C., and a time period from about 1 hour to 10 hours.

In the shaft processing step (S203), surfaces of the sintered body and joint surfaces are subjected to a lapping process, or the like.

Next, the ceramic base and the shaft obtained by the above-described methods are joined together (S300). In this joining step (S300), a rare earth compound is applied to one or both of the joining surfaces as a joining agent. Thereafter, the joining surfaces are attached to each other and are then subjected to a heat treatment in a nitrogen atmosphere and in a temperature in a range from 1700° C. to 1900° C. It is also possible to apply a certain pressure uniaxially from a direction perpendicular to the joining surfaces where appropriate. In this way, the ceramic base and the shaft are joined together by solid-state welding. Instead of solid-state welding, it is also possible to use brazing solder or mechanical joining.

Moreover, a feed bar made of Ni or the like is inserted into the shaft. The electrode terminal of the ceramic base is joined to the feed bar inserted into the shaft by brazing solder, allowing for the joining of the terminal (S400). Instead of the feed bar, it is also possible to use another feeder, such as a linear conductive material formed into a rope or a conductive material formed into a ribbon. Additionally, by providing screw grooves on an outer periphery of the feed bar and providing screw grooves on the ceramic base, and by screwing of the feed bar into the ceramic base, it is also possible to achieve the joining to the electrode terminal.

Thereafter, an inspection (S500) is performed in terms of the temperature uniformity, adsorption uniformity, and the like, thus completing the substrate heater 2 provided with the electrostatic chuck.

The size and shape of the ceramic base and the shaft are not particularly limited. Meanwhile, when a diameter of the heating surface of the ceramic base is expressed by D1 and a diameter of the cross-section of the shaft is expressed by D2, it is preferable to set D2/D1 to be in a range of ½ to 1/10, for example. In this case, it is possible to obtain the effect of forming the heating surface into the convex shape more surely.

With regard to the process of the heating surface of the ceramic base, it is also possible to perform a correction operation after the inspection step (S500) to reflect the results of the inspection.

When fabricating the substrate heater 1 without the adsorption function as shown in FIG. 1A, it is possible to omit the step of embedding the electrostatic chuck from the steps. When fabricating the substrate heater 3 provided with the vacuum chuck as shown in FIG. 2B, in order to fabricate exhaust holes for the vacuum chuck, the ceramic base is separated into a plurality of pieces, thus fabricating preliminary compacts, for example. Then, each preliminary compact is provided with a groove, and the grooves are attached together to form the exhaust holes.

As described above, according to the substrate heater of the present invention and the fabricating method thereof, temperature uniformity of the substrate is achieved by the simple steps of forming the heating surface into a convex shape. It is only necessary to add these simple steps to the conventional steps. Moreover, it is also possible to perform the correction operation after the inspection where appropriate. Accordingly, the present invention is extremely practical.

EXAMPLES

The following describes Examples 1 to 7 and Comparative Examples of the present invention.

Each of the substrate heaters according to the Examples 1 to 7 corresponds to the substrate heater provided with the electrostatic chuck as shown in FIG. 2A. The substrate heaters are fabricated under the same conditions except that the conditions for processing the heating surface of the ceramic base into the convex shape are different from one another. The concrete conditions of fabrication will be described below. The conditions of fabrication refer to the flowchart shown in FIG. 3.

Conditions of Fabrication

Firstly, the ceramic base was fabricated, with the electrostatic chuck electrode and the resistance-heating element embedded therein (S100). An acrylic resin binder was added to a ceramic mixed powder which was prepared by adding 5% of $Y_2O_3$ to AlN powder obtained by a reduction-nitridation method, and granules were formed by a spray granulation method. The granules were put into a mold and pressed, thereby fabricating the preliminary compact. On the preliminary compact, a groove was formed in a position for embedding the resistance-heating element by use of a transfer mold. An Mo resistance-heating element having a wire shape and a diameter of 0.5 mm, which has been formed into a coil shape as shown in FIG. 3, was mounted in this groove. The ceramic raw material powder was put on the resistance-heating element, and these constituents were pressed. An electrostatic chuck electrode made of 24-mesh Mo wire mesh and having a diameter of 0.35 mm was mounted thereon, and then the ceramic raw material powder was further put thereon. Then, all the constituents were pressed together again in the uniaxial direction. The pressure was set to be 200 kg/cm$^2$ in each case. In this way, the compact of the ceramic base with the resistance-heating element and the electrostatic chuck electrode embedded therein was formed (S101).

The compact was taken out and sintered in a hot press sintering furnace. Conditions for sintering were set to a nitrogen atmosphere at gauge pressure of 0.5 kg/cm$^2$ and at temperature of 1860° C., which was maintained for 6 hours, whereby the sintered body was formed. The outside diameter of the sintered body was about 290 mm, and the thickness thereof was about 17 mm (S102). The position for embedding the resistance-heating element had depth of 8.5 mm from the upper surface of the heating surface, and the electrostatic chuck electrode was embedded at depth of 1.0 mm.

The lift pins and the purge gas holes were formed on this sintered body. The surface of the ceramic base to be the heating surface was subjected to a grinding operation with a rotary flat-surface grinding machine by use of a 200-mesh diamond abrasive paper and a grind stone. In this way, as shown in Table 1, the heating surface was formed into a convex shape in which the height of the central portion thereof is the highest and the height of the heating surface was gradually reduced toward the peripheral portion thereof. The height of the central portion of the heating surface was expressed by Hc and the height of the edge portion of the heating surface was expressed by He, and the differences ΔH (=Hc−He) in the height were set to 2 μm, 6 μm, 12 μm, 27 μm, 34 μm, 42 μm, and 52 μm respectively in Examples 1 to 7 (S103).

The shaft was fabricated by the following conditions. An acrylic resin binder was added to a ceramic mixed powder which was prepared by adding 5% of $Y_2O_3$ to AlN powder obtained by a reduction-nitridation method, and granules were formed by a spray granulation method. By use of the granules, the compact was fabricated by applying the CIP method (S201).

The shaft compact was sintered by applying the normal pressure sintering method. Conditions for sintering were set to a nitrogen atmosphere and at temperature of 1850° C., which was maintained for 3 hours (S202). The diameter of an intermediate portion of the shaft obtained after sintering was about 40 mm, and the length of the shaft was about 200 mm. The thickness of the shaft at an intermediate portion of the tube was about 3 mm. The surfaces of the shaft and the joining surface to the ceramic base were subjected to a lapping operation (S203).

Yttrium nitrate aqueous solutions having an yttrium concentration of $2.6\times10^{-6}$ mol/cc was coated on the respective joining surfaces to the ceramic base and to the shaft. Both joining surfaces were attached to each other, and were subjected to a heat treatment in a nitrogen atmosphere and at temperature of 1800° C. for 2 hours (S300).

After joining, the feed bar made of Ni was joined by brazing solder to the respective terminals for the resistance-heating element and for the electrostatic chuck electrode which were embedded in the ceramic base (S400).

Evaluation

Each of the substrate heaters of Examples 1 to 7, and of the Comparative Examples, was placed in a hermetically sealed chamber for evaluation, and a silicon substrate having a diameter of 300 mm was mounted on the heating surface. The inside of the chamber was set to a vacuum condition of 77 KPa, electricity was supplied to the electrostatic chuck electrode, and then electricity was supplied to the resistance-heating element while fixing the substrate to the heating surface by adsorption. The temperature distribution on the substrate surface was measured under a condition of setting substrate temperature to 450° C. The results are shown in Table 1.

The temperature of the substrate surface was measured by use of a thermocouple. Each value in the row "temperature of outer peripheral portion of substrate" in Table 1 shows an average value of the temperature on the substrate surface measured at four points which divide a circumference having a radius of 140 mm into four equivalents. The temperature of the heating surface of the ceramic base itself was measured with a thermoviewer. In each of Examples 1 to 7 and the Comparative Examples, the surface temperature at the central portion of the heating surface was substantially equal to 449° C., the surface temperature at the edge portion of the heating surface was substantially equal to 458° C., and the temperature at the central portion was lower by 9° C.

As shown in Table 1, it was confirmed that the temperature distribution on the substrate surface was changed by forming the heating surface into the convex shape and by varying the difference ΔH in the height between the central portion and the edge portion thereof. The temperature uniformity of the substrate tended to be more improved with an increase in the difference ΔH over a ΔH range of 2 μm to about 50 μm. Particularly, in Example 6, the difference ΔH of 42 μm substantially eliminated the temperature difference between the central portion and the outer peripheral portion of the substrate. The difference ΔH exceeding 50 μm does not exhibit sufficient adsorption by the electrostatic chuck at the outer peripheral portion of the substrate, and the substrate was caused to float and stable retention was complicated. Therefore, a difference ΔH that is equal to or below 50 μm is preferred to obtain fine temperature uniformity and stable retention of the substrate. Under the setting condition of 450° C., a difference ΔH of at least 27 μm can suppress deviation in the temperature uniformity of the substrate temperature within 3° C. A difference ΔH that is at least 34 μm can suppress deviation in the temperature uniformity of the substrate temperature within 1° C.

TABLE 1

| EXAMPLE | EXAMPLE 1 | EXAMPLE 2 | EXAMPLE 3 | EXAMPLE 4 | EXAMPLE 5 | EXAMPLE 6 | EXAMPLE 7 |
|---|---|---|---|---|---|---|---|
| HEATING SURFACE FLATNESS OF CERAMIC SUBSTRATE ΔH = (Hc − He) (μm) | 2 | 6 | 12 | 27 | 34 | 42 | 52 |
| SUBSTRATE SURFACE TEMPERATURE (CENTRAL PORTION) Tc (° C.) | 447 | 447 | 447 | 448 | 448 | 449 | 449 |
| SUBSTRATE SURFACE TEMPERATURE (OUTER PERIPHERAL PORTION) Te (° C.) | 454 | 453 | 451 | 451 | 449 | 449 | 448 |
| SUBSTRATE TEMPERATURE UNIFORMITY Tc − Te (° C.) | −7 | −6 | −4 | −3 | −1 | 0 | 1 |

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

The invention claimed is:

1. A substrate heater comprising:

a plate-shaped ceramic base having a first side defining a convex heating surface on at least a portion of which a substrate is placed;

a resistance-heating element embedded in the ceramic base; and a tubular member joined to a central portion on an opposed second side of the ceramic base;

wherein a height of the heating surface decreases from a central portion of the heating surface to a peripheral portion thereof.

2. The substrate heater of claim 1, wherein the ceramic base comprises a planar electrode embedded therein between the heating surface and the resistance-heating element.

3. The substrate heater of claim 2, wherein the planar electrode comprises one of a mesh-shaped electrode of a metal bulk body and a plate-shaped electrode with open holes.

4. The substrate heater of claim 1, further comprising a vacuum chuck hole on the heating surface configured to adsorb and fix the substrate on the heating surface.

5. The substrate heater of claim 1, wherein a difference ΔH between a height Hc at the central portion of the heating surface and a height He at the peripheral portion of the heating surface is 50 μm or less.

6. The substrate heater of claim 5, wherein the difference ΔH is at least 10 μm.

7. The substrate heater of claim 1, wherein the ceramic base comprises a main component including one of a non-oxide ceramic and a composite of at least two non-oxide ceramics selected from the group consisting of aluminum nitride, silicon nitride, silicon carbide and sialon.

8. The substrate heater of claim 1, wherein a main component of the tubular member is identical to that of the ceramic base.

9. A method for fabricating a substrate heater, comprising the steps of:

embedding a resistance-heating element in a plate-shaped ceramic base;

grinding a first surface of the ceramic base to form a convex heating surface having a height that decreases from a central portion of the heating surface to a peripheral portion thereof; and joining a tubular member to a central portion of an opposed second surface of the ceramic base.

10. The method of claim 9, wherein the embedding step further comprises embedding a planar electrode in the ceramic base.

11. The method of claim 9, wherein the grinding step further comprises the step of adjusting a difference ΔH between a height Hc at the central portion of the heating surface and a height He at the peripheral portion of the heating surface to be 50 μm or less.

12. The method of claim 11, wherein the difference ΔH is adjusted to at least 10 μm.

* * * * *